United States Patent [19]

Steverlynck

[11] 4,127,150

[45] Nov. 28, 1978

[54] RAPIER DRIVING DEVICE ON RAPIER LOOMS

[75] Inventor: Patrick A. Steverlynck, Vichte, Belgium

[73] Assignee: Weefautomaten Picanol N.V., Ieper, Belgium

[21] Appl. No.: 726,227

[22] Filed: Sep. 24, 1976

[30] Foreign Application Priority Data

Oct. 6, 1975 [NL] Netherlands ..... 7511709

[51] Int. Cl.[2] ..... D03D 47/00

[52] U.S. Cl. ..... 139/449

[58] Field of Search ..... 139/1 E, 110, 440, 441, 139/443, 444, 445, 446, 449

[56] References Cited

U.S. PATENT DOCUMENTS

| | | | |
|---|---|---|---|
| 1,739,171 | 12/1929 | Paine | 139/449 |
| 1,957,024 | 5/1934 | Klemm | 139/449 |
| 2,258,193 | 10/1941 | Payne | 139/449 |
| 2,946,352 | 7/1960 | McKeown | 139/110 |
| 3,198,215 | 8/1965 | Tinkham | 139/449 |
| 3,981,332 | 9/1976 | Schwarz | 139/449 |

*Primary Examiner*—Henry S. Jaudon

*Attorney, Agent, or Firm*—Bacon & Thomas

[57] ABSTRACT

The invention pertains to a driving device for rapiers on rapier looms of the type equipped with two rapiers, each carrying a gripper, whereby the rapiers are driven by the motor of the loom, which is provided with an adjustable reduction gear unit, via, for each rapier, a multiplier driving device comprising a series of successive points of rotation, whereby means are provided for the adjustment of the relative distance between two successive points of rotation of at least one multiplier driving device, characterized by the fact that aforesaid adjusting means are fitted with control means with which they can be continuously adjusted between two limit values selected in advance.

5 Claims, 8 Drawing Figures

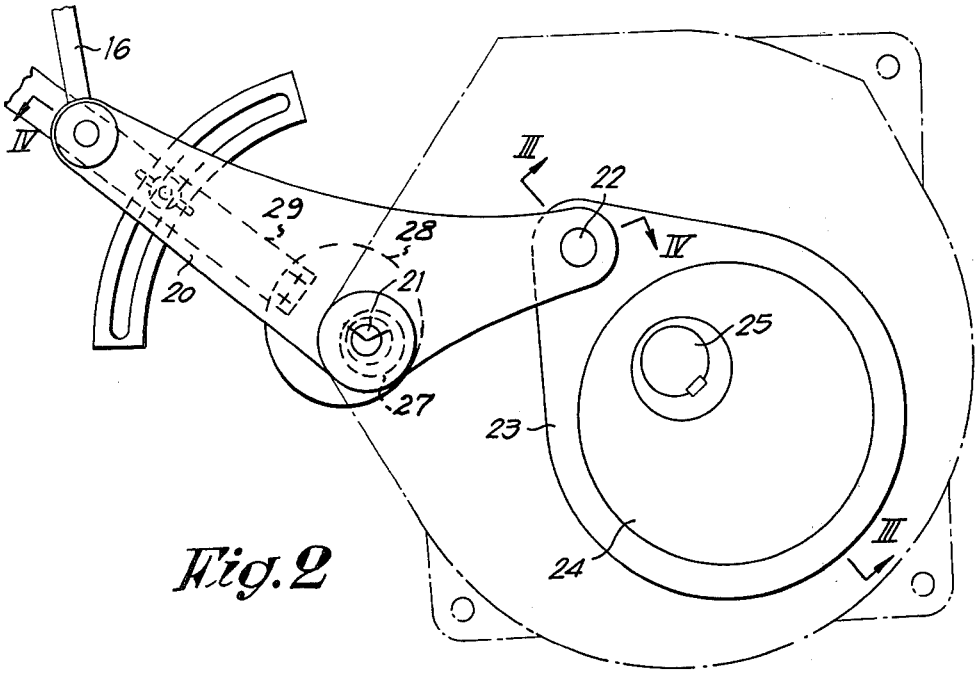
Fig. 2
Fig. 3
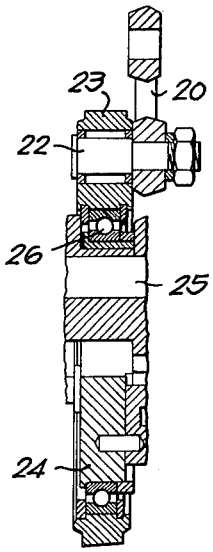
Fig. 6
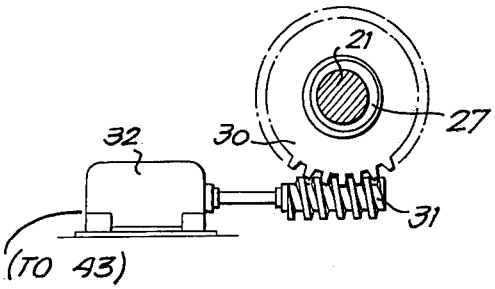
Fig. 7
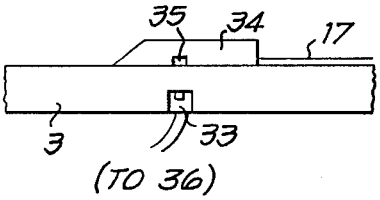

RAPIER DRIVING DEVICE ON RAPIER LOOMS

The present invention is concerned with a rapier driving device on a rapier loom.

The invention is more particularly applicable to rapier looms of the type fitted with two rapiers, each of which carry a gripper, whereby these rapiers are each driven by a multiplier driving device comprising a series of successive pivoting points.

For such rapier looms, means have already been suggested for adjusting the mutual spacing between two successive pivoting points of aforementioned driving device, in order to reach an appropriate transfer position for aforesaid grippers. These known means can however only be controlled when the loom is not operating and by the use of wrenches and suchlike.

The applicant has found that it would be most useful if a loom of the type under consideration could be run when desired at very low speed, in order for instance to check and adjust the synchronization between the various devices which take part in the entering of the weft.

It is a fact that modern looms rotate so fast, that the entering process cannot be properly checked without the use of a stroboscope.

The running at low speed of a rapier loom does cause difficulties, because it requires a different adjustment of the rapier driving device than that which is normally required for high speed operation.

A first purpose of the invention is consequently to provide a rapier driving device which can almost instantaneously be adjusted so as to be able to weave, according to wish, either at high or at low speed.

For this purpose, a driving device of the type under consideration is proposed, in which aforesaid adjusting means are provided with control means with which they can be continously adjusted between two predetermined limit values.

According to one of the numerous possible forms of embodiment of the invention, the aforesaid control means comprise a step-by-step motor which is controlled by a detector fitted in the slay, whereby this detector cooperates with a small magnet provided for this purpose in one of the grippers.

The characteristics and properties of the invention will be clearly understood from the description hereinafter, with reference to the appended drawings in which:

FIG. 2 shows the actual drive of the multiplier according to FIG. 1;

FIG. 3 shows a cross-section according to line III—III in FIG. 2;

FIG. 6 shows an alternative form of embodiment of that part illustrated in FIG. 5;

FIG. 7 shows a schematic illustration of a control device for a gripper; and

Figure 1:
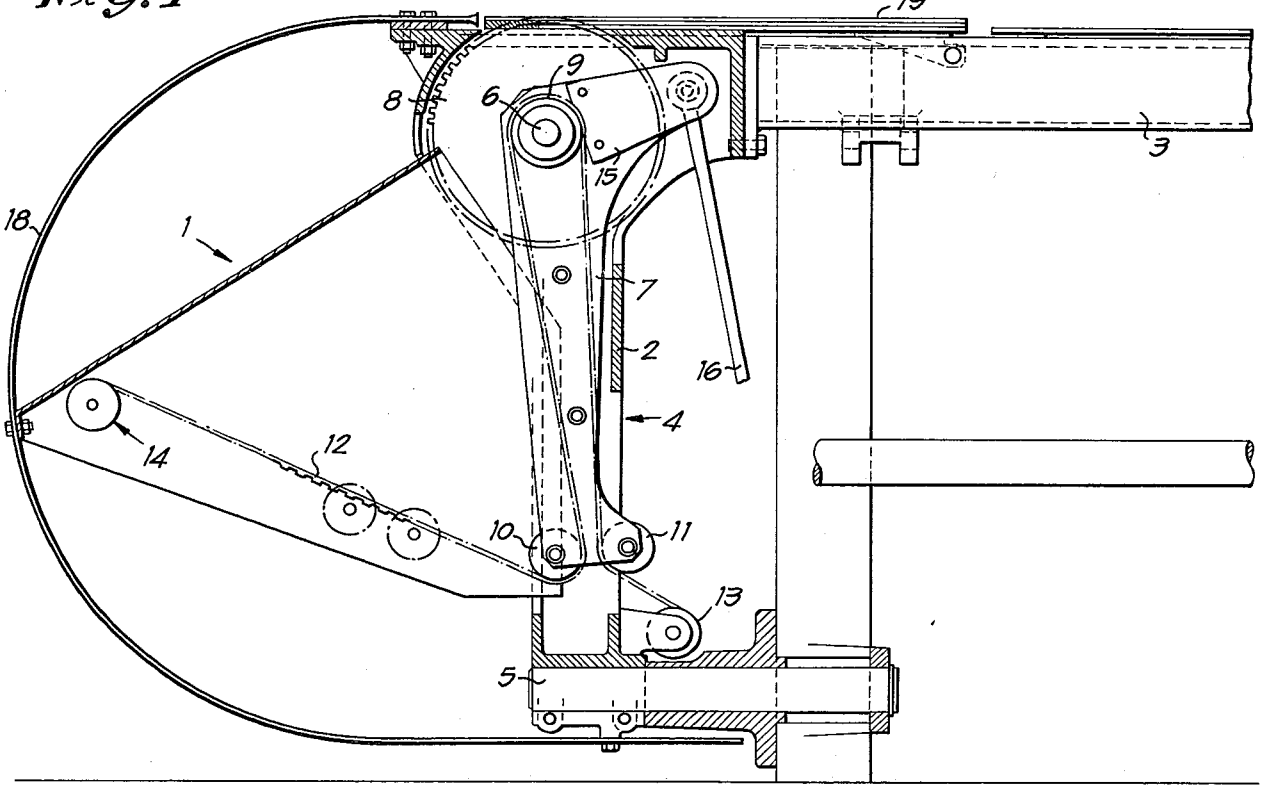
FIG. 1 shows a multiplier for the drive of a rapier of a rapier loom.
Figure 4:
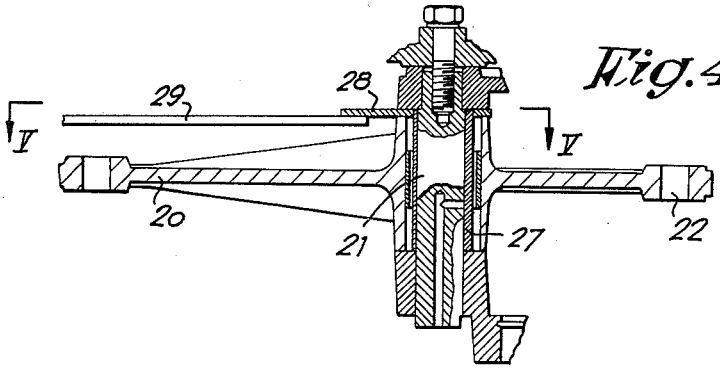
FIG. 4 shows a cross-section according to line IV—IV in FIG. 2.

The multiplier which is shown in FIG. 1 is of the type described in U.S. patent application Ser. No. 720,593 filed Aug. 2, 1976, the disclosure of which is incorporated herein by reference. The rapier drive multiplier of this invention is fitted in a housing 2, which is attached to one end of the slay 3 and which simultaneously serves the purpose of a slay sword 4 and is fitted pivotingly around shaft 5 of the slay.

In housing 2 a shaft 6 is provided, upon which are fitted for oscillation on the one hand, a rocker lever 7 and on the other hand, a gear 8 to which a pinion 9 is fixed.

At the end of rocker lever 7 which is furthest removed from shaft 6, two guiding rollers or wheels 10 and 11 are rotatably fitted.

A flexible element 12, such as a chain, a toothed belt or suchlike, is attached by one of its ends to a fixed point 13 of the device, and is led subsequently over roller 11, pinion 9 and roller 10, whereby its other end is attached to a fixed point 14 of the device.

Rocker lever 7 is provided with a laterally protruding arm 15 which is connected by means of a rod 16 to driving means described further on, with which lever 7 is alternately swung from one ot its end positions (full line, FIG. 1) to its other (when swung to the left).

Gear 8 meshes with a perforated rapier or lance 17 (FIG. 7) which is guided through guides 18 and 19. This rapier or lance 17 may for instance be fabricated from a strip of flexible plastic material, as is in itself well known.

Rod 16 is pivotally connected to one end of a bell crank 20 (FIG. 2) which is journalled on a pivot 21, and of which the other end is pivotally connected at 22 to a plate 23. The latter is fitted around an eccentric 24 which is fixed to a drive shaft 25. A ball bearing 26 is provided between plate 23 and eccentric 24.

Figure 5:
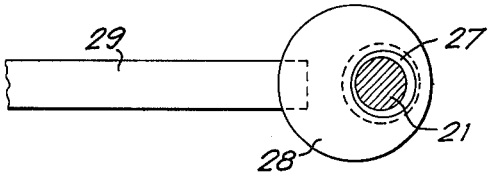
FIG. 5 shows a cross-section according to line V—V in FIG. 4.

Around pivot 21 an eccentrically bored bushing 27 is fitted, which is provided with a flange 28 (FIG. 5). To this flange one end of a control lever 29 is attached (FIG. 5).

When lever 29 is oscillated, this entails the displacement of pivot 21. This modifies the relative positions between pivoting points 21 and 22, thus enabling the adjustment of the driving device.

A locking device, as shown in FIG. 2, can be provided for lever 29, either to lock the latter in the one or the other of two selected positions (high speed — low speed), or to lock it not merely in the two previously mentioned positions, but also in any of the intermediate positions.

There shall preferably be provided a switch not shown controlled by lever 29 in order to prevent the loom from being started at high speed when the lever 29 is in "low speed" position, or conversely.

Figure 8:
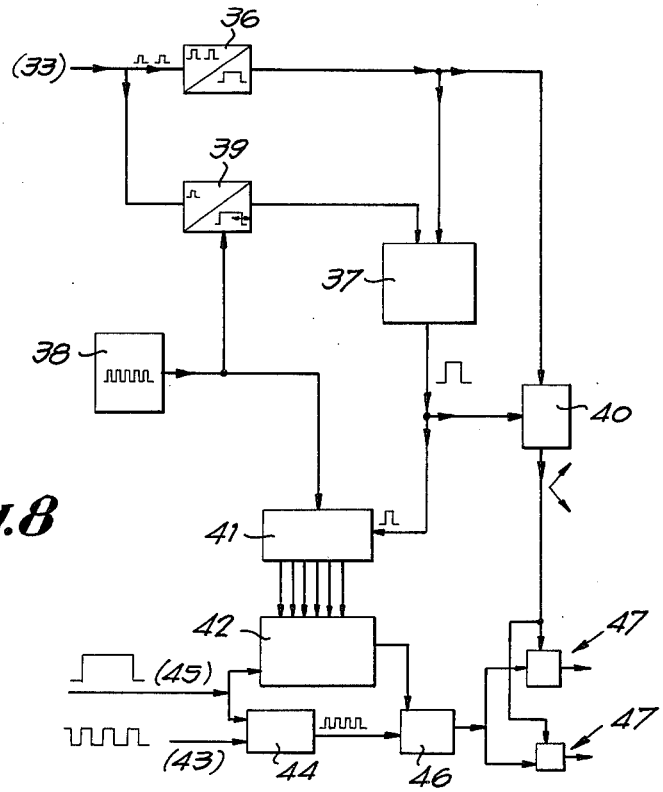
FIG. 8 shows a block diagram of a circuit for controlling the motor illustrated in FIG. 6.

In FIGS. 6 - 8 a modification is schematically shown which provides for a continuous adjustment of the driving device, particularly during normal weaving. In other words, the relative position of the grippers during transfer is under permanent control and can, if needs be, be adjusted.

For this purpose, bushing 27 is fitted with a pinion 30 which meshes with a worm wheel 31. Worm wheel 31 may be driven by a step-by-step motor 32 (FIG. 6).

In slay 3, (FIG. 7) a detector or induction switch 33 is fitted. At least one gripper, for instance gripper 34, is equipped with a small magnet 35. It should be noted that gripper 34, once past detector 33 (to the left in FIG. 7) is mainly subjected to stresses subsequent to an acceleration in one direction.

Detector 33 is for instance located at about three cm from the extreme position which small magnet 34 can reach near the center of the slay (FIG. 7).

The signals emitted by detector 33 are further processed in the circuit according to FIG. 8. At 36 they are converted to time impulses $t_1t_2$ which are compared at 37 with reference impulses $t_1t_0$ which are produced by an impulse generator 38 and can be adjusted at 39. Any possible difference between these impulses, respectively $t_1t_2$ and $t_1t_0$, with an indication of the sense of said difference, is stored in a memory 40 until the next shot. This difference is sent at the same time to a counter 41, where it is compared with the counting impulses generated by 38. This comparison is used, at 42 for the preselection of the number of steps to be performed by the motor.

The motor displacement impulses 43 are sent, via a gate 44, controlled by synchronization impulses 45 generated for instance by a degree counter fitted on the crankshaft of the loom, via a counter 46 fed from the preselection 42, and via a direction selector 47, controlled by memory 40, to motor 32.

Obviously, the invention is by no means limited to the forms of embodiment described above as examples, as many alternatives are possible within the scope of the following claims.

What I claim is:

1. A driving device for rapiers of rapier looms carrying a gripper, wherein the rapier is driven by a motor of the loom and which is provided with an adjustable reduction mechanism for a multiplier driving device comprising a series of links joined at pivot means wherein means are provided for adjustment of the distance between two of said pivot means; said means for adjusting said distance comprising an eccentric bushing supporting one of said pivot means, said adjusting means having a control member for adjusting said eccentric whereby the same may be continuously adjusted between two limit values.

2. A device as defined in claim 1 wherein said control member is a lever fixed to said eccentric bushing.

3. A device as defined in claim 1 wherein said control member is a pinion fixed to said eccentric bushing and a worm wheel, driven by a stepping motor, meshing with said pinion.

4. Driving device according to claim 3, characterized by the fact that said motor is continuously controlled by a detector fitted in the slay of the loom, which cooperates with a small magnet in the gripper.

5. Driving device according to claim 4, characterized by the fact that the signal produced by said detector in the course of a shot is used to control the motor in the course of the next shot.

* * * * *